US008376178B2

(12) United States Patent
Steinberg

(10) Patent No.: US 8,376,178 B2
(45) Date of Patent: Feb. 19, 2013

(54) HINGED OVERFLOW PAN

(76) Inventor: Leonard Steinberg, Carlsbad, CA (US)

( * ) Notice: Subject to any disclaimer, the term of this patent is extended or adjusted under 35 U.S.C. 154(b) by 1282 days.

(21) Appl. No.: 12/104,240

(22) Filed: Apr. 16, 2008

(65) Prior Publication Data

US 2009/0261108 A1 Oct. 22, 2009

(51) Int. Cl.
*B65D 1/34* (2006.01)
*B65D 25/14* (2006.01)

(52) U.S. Cl. ..... 220/571; 220/558; 220/495.01

(58) Field of Classification Search ..... 220/571, 220/573, 558, 495.01
See application file for complete search history.

(56) References Cited

U.S. PATENT DOCUMENTS

| | | | | | |
|---|---|---|---|---|---|
| 3,304,950 | A | | 2/1967 | Hubert | |
| 4,422,547 | A | * | 12/1983 | Abe et al. | 206/454 |
| 4,889,155 | A | | 12/1989 | Trotter, Sr. | |
| 4,903,723 | A | | 2/1990 | Sublett | |
| 5,016,772 | A | * | 5/1991 | Wilk | 220/8 |
| 5,090,588 | A | * | 2/1992 | Van Romer et al. | 220/573 |
| 5,364,592 | A | * | 11/1994 | Lewis et al. | 422/63 |
| 5,452,739 | A | * | 9/1995 | Mustee et al. | 137/312 |
| 5,503,294 | A | * | 4/1996 | Taylor et al. | 220/571 |
| D388,566 | S | | 12/1997 | Reid et al. | |
| 5,720,410 | A | * | 2/1998 | Umiker | 220/4.26 |
| 5,816,743 | A | * | 10/1998 | Schmitz, Jr. | 405/53 |
| 5,883,300 | A | | 3/1999 | Johnson | |
| 5,964,371 | A | * | 10/1999 | McCabe | 220/571 |
| 6,305,567 | B1 | * | 10/2001 | Sulpizio | 220/495.11 |
| 6,691,884 | B1 | * | 2/2004 | Dwyer | 220/4.03 |
| 6,938,792 | B2 | * | 9/2005 | Gerger | 220/571 |
| 6,988,848 | B2 | * | 1/2006 | Arsenault et al. | 404/39 |
| 7,083,060 | B2 | * | 8/2006 | Pickler | 220/1.5 |
| 7,617,947 | B2 | * | 11/2009 | Schafer | 220/558 |
| 7,735,510 | B1 | * | 6/2010 | Carter | 137/312 |
| 2006/0102633 | A1 | * | 5/2006 | Schafer | 220/558 |

* cited by examiner

*Primary Examiner* — Mickey Yu
*Assistant Examiner* — Niki Eloshway
(74) *Attorney, Agent, or Firm* — Knobbe Martens Olson & Bear LLP

(57) ABSTRACT

The operation of certain appliances and machinery includes the flow of water through the appliance or storage of fluid within the appliance, leading to the risk of significant fluid leakage. An overflow pan may be provided beneath the appliance to contain any fluid leakage. The overflow pan may include a movable portion which is configured to permit passage of a horizontally-extending portion of the appliance, such as a drawer. This movable member may be biased to return to a closed position when the horizontally-extending portion of the appliance is retracted, so as to form a fluid-retaining seal with the remainder of the overflow pan.

27 Claims, 7 Drawing Sheets

HINGED OVERFLOW PAN

BACKGROUND OF THE INVENTION

Field of the Invention

The operation of certain appliances includes the flow through the appliance of a substantial amount of water or other fluid, such as washing machines or water heaters, for example. Operation of time in the presence of a leak, or any relatively substantial leak or other mechanical failure can result in a substantial amount of fluid leaking from such an appliance. In order to contain such a leak, an overflow pan, commonly referred to as a smitty pan, can be installed underneath the appliance, so as to temporarily retain the fluid until such time as the fluid is removed or drained through an aperture in the base of the overflow pan to a suitable drain or drainage system.

Certain of these appliances comprise horizontally extendable components, the operation of which may be inhibited by the sidewall of an overflow pan. For example, front-loading washers or dryers are typically seated on a pedestal or platform so as to bring the door of the washer or dryer to a comfortable height. Such pedestals or platform may comprise a horizontally extending drawer, the bottom of which may, in certain embodiments, be situated only a small distance above the floor or ground surface. When an overflow pan is installed underneath, for example, a washing machine, the drawer may not have sufficient clearance to pass over the sidewall of the overflow pan, or may only pass over the sidewall of the overflow pan if the sidewall of the overflow pan is bent or otherwise distorted. Such bending or distortion if undesirable for various reasons, including that causing such bending or distortion may be difficult to effect and lead to permanent damage of the overflow pan, and loss of its ability to temporarily retain fluid.

SUMMARY OF THE INVENTION

In one embodiment, an overflow pan is provided, including a substantially flat base portion, a sidewall structure extending transversely upward from the base to define a fluid-retaining basin, the sidewall structure including a first portion permanently affixed to the base portion, and a second portion connectively affixed to the base portion and movable between a first position in which the second portion is positioned relative to the first portion so as to maintain a fluid-tight seal between the second portion and the first portion, and a second position in which at least part of the second portion is spaced apart from the first portion, and where the second portion is biased to return to the first position.

In another embodiment, a method of installing such an overflow pan is provided, the method including positioning the overflow pan over a drain, forming an aperture extending through the base portion, and aligning the aperture with the drain.

In another embodiment, an overflow pan configured to permit the passage of a longitudinally extending portion of an appliance seated within the pan is provided, the overflow pan including a base, the base including a laterally extending side, a sidewall extending upward from the base, the sidewall including: a first portion fixed relative to the base, and a second portion connected to the laterally extending side of the base via a hinge at the base of the first portion, and a biasing structure configured to pull the second portion into an upright position where the second portion cooperates with the base and the first portion of the sidewall to define a fluid-retaining space, where the second portion is configured to interact with a longitudinally extending portion of an appliance positioned within the pan to rotate the second portion of the sidewall about the hinge into a lowered position so as to permit the extension of the longitudinally extending portion of the appliance.

In another embodiment, a hinged containment pan is provided, the pan including a base, the base including a front side, two lateral sides, and a back side, a sidewall extending around the sides of the base, where at least a portion of the sidewall adjacent the front side of the base is movable relative to the remainder of the sidewall, and a connector extending between the movable portion of the sidewall and a fixed component of the containment pan, where the connector is configured to exert a force on the movable portion to pull the movable portion towards a position in which the movable portion cooperates with the remainder of the sidewall to retain fluid within the containment pan.

In another embodiment, an overflow pan configured to permit the horizontal movement of a portion of a device retained therein is provided, the overflow pan including a base area, a sidewall extending substantially upward from the base area, the sidewall including a fixed sidewall portion and a movable sidewall portion slidably coupled to the fixed sidewall portion, where the movable sidewall portion is configured to be laterally displaced with respect to the fixed sidewall portion when a horizontally extending portion of a device retained within the overflow pan contacts an interior surface of the movable sidewall portion,

DETAILED DESCRIPTION OF THE PREFERRED EMBODIMENT

Certain embodiments of overflow pans are disclosed in the context of use in conjunction with an appliance, and in particular in conjunction with a washing machine. For convenience, the appliance to be retained may be referred to, in the context of the present disclosure, as a washing machine seated upon a pedestal comprising a horizontally-extending drawer.

The principles of these embodiments, however, are not limited the specific type of appliances or washing machines discussed with respect to the below embodiments. Instead, it will be understood by one of skill in this art, that the overflow pan disclosed herein also can be successfully utilized in connection with other types of appliances, including, for example, dish washing machines, refrigerators, freezers, water heaters, and the like, whenever temporary or extended retention of fluid is desired.

Such an overflow pan can be used not only in conjunction with appliances for which the operation of the appliance includes flow of fluid through the device or retention of fluid within the device, but also in conjunction with appliances or other structures or objects which may be exposed to large amounts of fluid, such as a device which is to be cleaned by a substantial amount of fluid, or any device which deploys or uses fluids as part of its general operation and function. For example, rapid fluid leakage may be due to machinery leaks, failure of hoses, transitional piping, or other fluid conduits, failure of fluid storage vessels or other fluid containment devices. In particular embodiments, machines such as dishwaters, refrigerators, washing machines, medical equipment, research equipment, or other mechanical equipment may be used in conjunction with such an overflow pan. One skilled in the art may also find additional applications for the devices and structures disclosed herein.

Figure 1A:
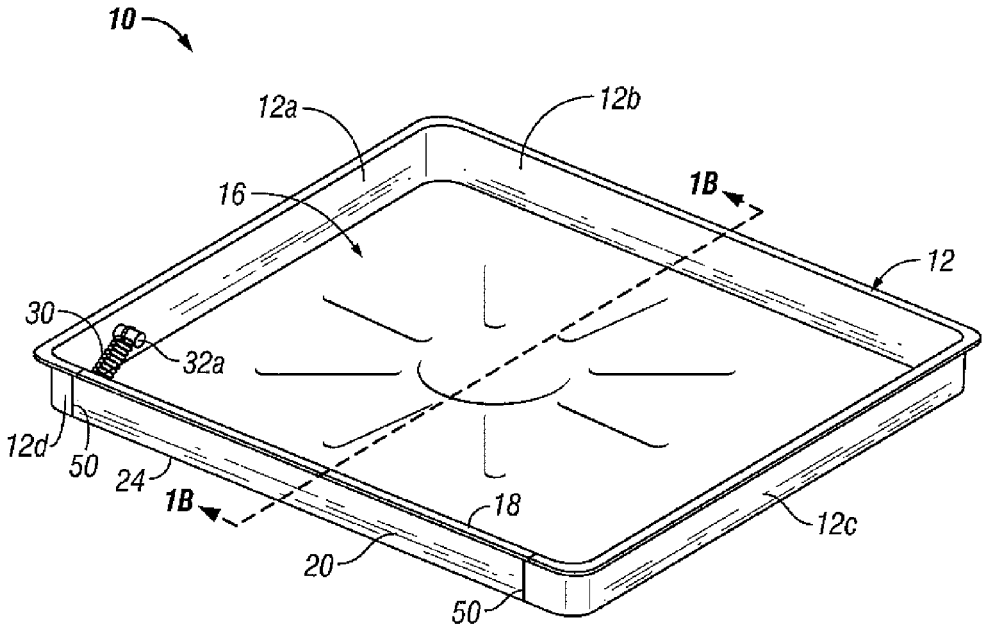
FIG. 1A is a perspective view of one embodiment of a hinged overflow pan.

With reference now to a first embodiment, FIG. 1A illustrates in perspective view a hinged overflow pan 10 comprising a movable sidewall portion 20. The remainder of the sidewall structure 12 is substantially fixed relative to the base 14 of the hinged overflow pan 10.

To assist in the description of the components of the hinged overflow pan 10, and with respect to FIG. 1A, the following coordinate terms are used. A "longitudinal direction" is generally parallel to the plane of base 14 of hinged overflow pan 10 and parallel to the movable sidewall portion 20. A "lateral direction" is normal to the longitudinal axis and is also generally parallel to the plane of the base 14, and is normal to the movable sidewall portion 20 when in a closed position. A "transverse direction" extends normal to both the longitudinal and lateral axes. Also, the terms "top", "bottom", "upper" and "lower" are used in the context of the orientation of the hinged overflow pan 10 illustrated in FIG. 1A, and are not intended to imply a limitation to the orientation that the hinged overflow pan 10 can assume in particular embodiments.

Still with reference to FIG. 1A, the movable sidewall portion 20 comprises a portion of a sidewall structure 12 which extends substantially transversely upward from the base 14, and cooperates with the base 14 to define a fluid retention area 16 which can at least temporarily retain at least some portion of fluid leaking into the overflow pan 10. In the illustrated embodiment, the sidewall structure 12 comprises a substantially square shape, comprising four substantially straight portions. The side sections 12*a* and 12*c* and the back section 12*b* of the sidewall are substantially fixed relative to the base 14. As previously noted, the movable sidewall portion 20 comprises a portion of the front section of the sidewall 12, but as only a central portion of the front section of the sidewall is movable in this embodiment, fixed portions 12*d* of the sidewall abut the lateral edges of the movable sidewall portion 20. In the illustrated embodiment, the sidewall 12 extends upward from the perimeter of the base 14, but in other embodiments, the base 14 may extend beyond the sidewall in at least some sections.

In order to provide a fluid retention space 16, one or both facing surfaces within the contact region 50 between the movable sidewall portion 20 and the fixed portions 12*d* of the sidewall may in certain embodiments be treated with a gasket material so as to prevent or inhibit fluid flow therebetween. It will be understood that slowing the rate of fluid flow through contact region 50 may, in certain embodiments, provide sufficient protection against fluid damage, although in other embodiments, additional protection may be provided so that substantially no fluid passes through the contact region. In particular embodiments, the gasket material may comprise, for example, neoprene or a similar open cell structural material, or another suitable porous material whose sealing properties may increase as they become moistened.

In addition, although the facing surfaces within contact region 50 illustrated in FIG. 1A are shown as longitudinally extending surfaces substantially parallel to the side portions 12*a* and 12*c* of sidewall 12, it will be understood that the facing surfaces within may be oriented at a different angle, for example, not substantially parallel, for example, more than 20°, more than 30°, or more than 45°, with respect to the interior surface of the movable sidewall. In particular embodiments, the surfaces may be oriented at an obtuse angle, for example, more that 45°, more than 60°, or more that 80°, with respect to the interior surface of the movable sidewall 20, such that movement of the movable sidewall away from the base 14 is permitted, but movement towards the base 14 is inhibited. When the movable sidewall portion 20 is held in place against such a facing surface, the providing of a fluid-tight seal may be facilitated. In alternate embodiments, tabs or other structures (not shown) may be provided to inhibit movement of the movable portion 20 towards the base 14 beyond the upright position shown, or friction between the facing surfaces in contact region 50 may inhibit such motion.

Figure 1B:
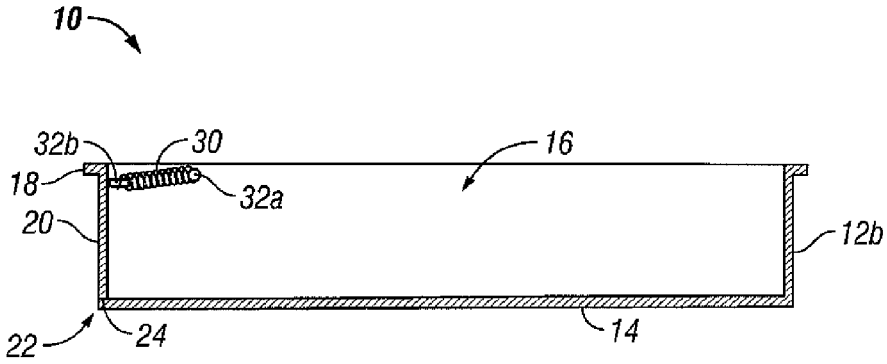
FIG. 1B is a cross-sectional elevation view of the hinged overflow pan of FIG. 1A, where the hinged overflow pan is shown in a closed position.

FIG. 1B is a cross-sectional view of the hinged overflow pan 10 of FIG. 1A taken along the line 1B-1B. Together with FIG. 1C, it illustrates the operation of the movable sidewall structure 20. In FIG. 1B, it can be seen that movable sidewall portion 20 is in a substantially upright position, as depicted in FIG. 1A. Hinge 22 connects the movable portion 20 to the base 14, and permits rotation of the movable portion 20 about the hinge 22. In particular, in the illustrated embodiment hinge 22 comprises a living hinge, wherein the bottom edge 24 of the movable portion 20 is substantially separated from the base, except for a thin portion which connects the movable portion 20 to the base 24. Because the thin portion is more flexible than the remainder of the comparatively thick movable portion 20 and base 14, this thin portion acts as a living hinge 22. Although the present embodiment is discussed with respect to a living hinge, it will be understood that any other suitable mechanical hinge may be provided either in conjunction with a living hinge to provide additional support, or as an alternative to a living hinge, such as in embodiments where the movable layer comprises a separate structure attached to the remainder of the overflow pan.

Figure 1C:
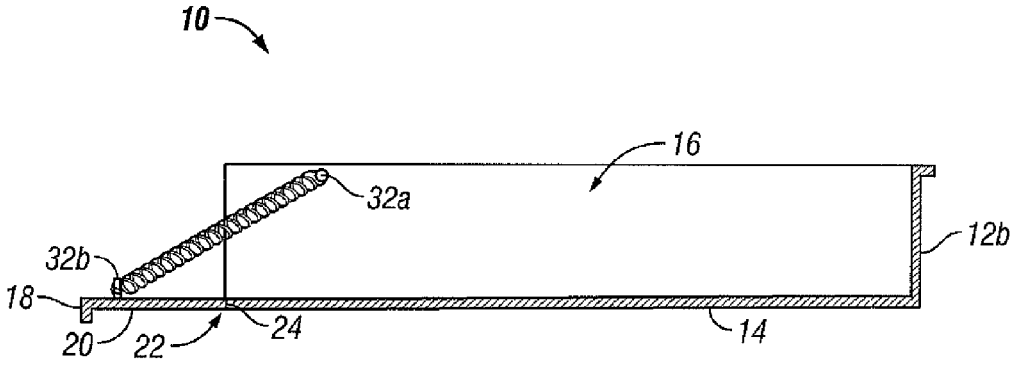
FIG. 1C is a cross-sectional elevation view of the hinged overflow pan of FIG. 1A, where the hinged overflow pan is shown in an open position.

In FIG. 1C, the movable portion 20 is depicted having been rotated about hinge 22 to a second position wherein the movable portion 20 is tilted away from the base 14 and the remainder of the hinged overflow pan 10. As discussed in greater detail in this disclosure, the movement of the movable portion 20 permits passage of an object through the space formerly occupied by the movable portion 20 when in the upright position.

In FIGS. 1A-1C, the movable portion 20 is depicted as connected to the fixed portion of sidewall 12 by a spring 30. One end of spring 30 is secured to a tab 32*a* extending from the interior surface of lateral sidewall 12*a* and the other end is secured to a tab 32*b* extending from the interior surface of movable layer. Another spring, not illustrated in FIGS. 1A-1C, may connect the movable portion to the other lateral sidewall 12*c*.

The movable portion 20 may be deflected downward to a lowered position. If the movable portion 20 is so deflected, the spring 30 may exert a force on the movable portion 20 so as to bias the movable layer 20 to return to an upright position. The spring 30 may also exert a force on the movable layer 20 when in an upright position to hold the movable layer in place, such as against a supporting tab or an angled facing surface of the fixed sidewall portions 12*d*.

Although the use of a spring, such as a linear spring to provide this biasing force, is described with respect to the present embodiment and certain embodiments disclosure herein, it will be understood by a skilled artisan that a wide variety of other structures may be utilized to provide such a biasing force. For example, although depicted as a linear coiled spring, any elastic material may be used as a linear spring. For example, an elastic band, or a rubber band may be used to connect the movable layer 20 to a fixed portion of the overflow pan. In other embodiments, more complex structures, such as mechanical or motorized armatures may be utilized, as well. In other embodiments, particularly when a mechanical hinge is utilized, a spring may be integrated into the mechanical hinge to provide such a biasing force.

In addition, although the spring 30 is depicted as attached to tabs 32*a* and 32*b* extending from the movable portion 20 and lateral portions of sidewall structure 12, it will be understood that the spring may connect the movable portion 20 to the fixed portion in other ways. For example, the spring can be directly attached to the sidewall portions, or can be secured via an adhesive. The tabs 32*a* and 32*b* may comprise hooks or other curved portions to facilitate attachment and/or removal of the spring 30 or other biasing member if replacement of the spring 30 is desired due to mechanical failure or other damage. In other embodiments, the spring 30 may be more permanently affixed, such as through the use of an adhesive.

It will also be understood by a skilled artisan that the spring may be used to connect the movable section 20 to any other component or portion of the overflow pan. For example, the spring may extend between the movable portion 20 and the base 14. In addition, although not shown, one or more protective structures may overlie at least a portion of the spring to prevent mechanical interference with the spring or damage to the spring.

The hinged overflow pan 10 may comprise a wide variety of materials, and may be formed using any of a variety of suitable methods. In certain embodiments, the overflow pan comprises a rigid but pliable material, such that the force exerted by the spring 30 will not permanently deform the components and such that the long-term operational utility of the overflow pan is preserved. However, some pliability of the pan, at least as to certain portions of the pan, may in certain embodiments be desirable, in order to minimize damage such as cracking or breaking which might occur when an appliance is seated within the overflow pan. Suitable materials may include, but are not limited to, ABS, PVC, silicone, rubber, silicon based rubbers, resins metals, stamped steel, stamped aluminum, plastics, or compressed degradeable paper, which may be treated with wax. In addition, a wide variety of composite materials comprising one of more of the above-listed materials may be used.

In certain embodiments, the hinged overflow pan 10 may be formed via a molding process. Suitable molding processes include, but are not limited to, injection molding, pressure forming, vacuum forming, and sheet forming.

The hinged overflow pan may be formed as a contiguous structure, particularly when a living hinge is used to connect the movable portion to the remainder of the pan. In further embodiments, post-molding processes may be used to form a living hinge and define the movable portion, to apply a gasket material to the facing surfaces of a contact region, or to install a spring or other biasing structure or mechanism.

In other embodiments, multiple components may be formed separately and assembled together. In some embodiments, as noted above, the movable portion of the sidewall may comprise a distinct structure which is attached to the remainder of the pan, such as by a mechanical hinge. In other embodiments, the sidewall structure may comprise one or more distinct components which are secured relative to a base. In embodiments in which multiple components are assembled to form an overflow pan, the joints between these components may be covered with a liner material or a gasket material to prevent fluid leakage between such components.

Figure 2A:
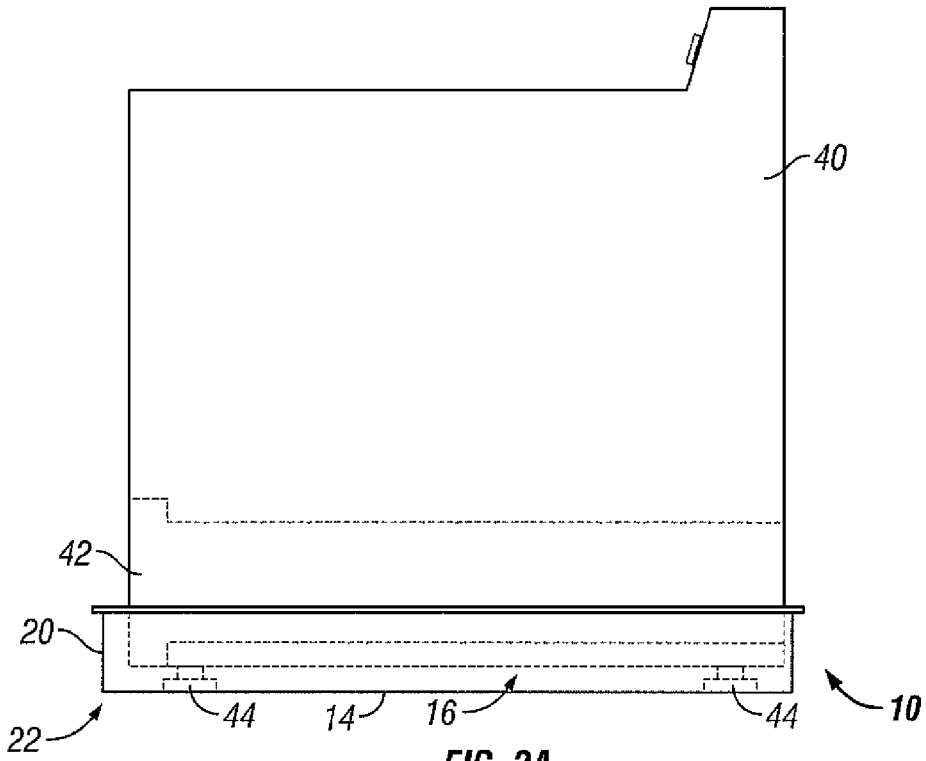
FIG. 2A is a side view of a washing machine seated within the hinged overflow pan of FIG. 1A.
Figure 2B:
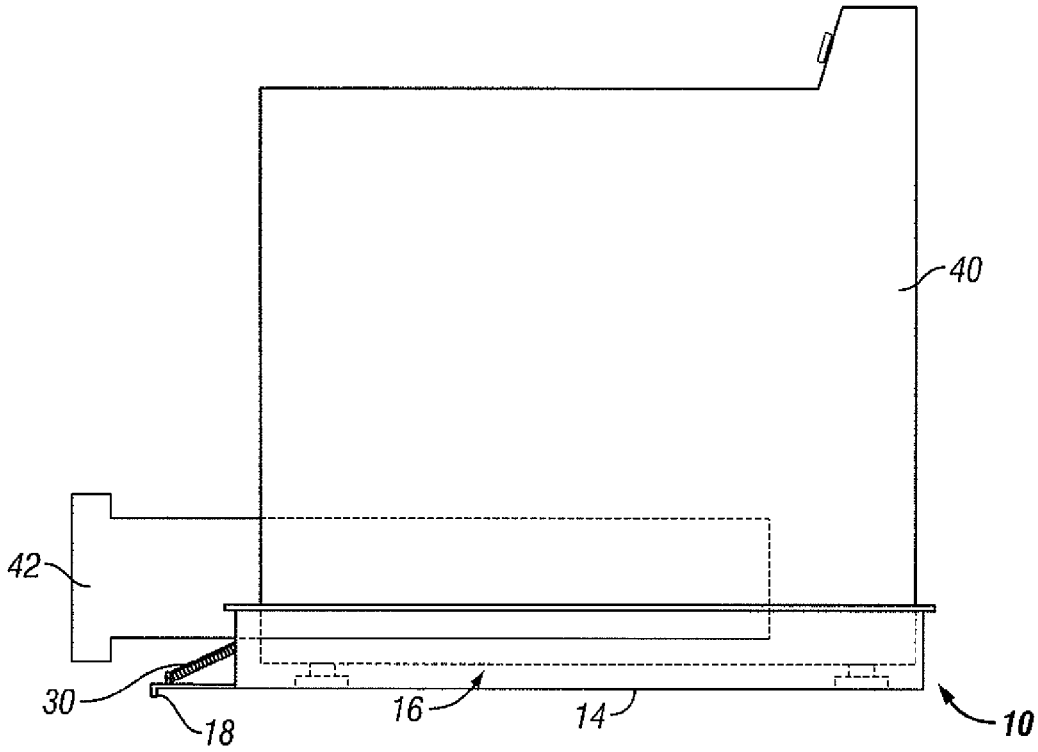
FIG. 2B is a side view of the washing machine of FIG. 2A, where a horizontally extending drawer is shown in an extended position and has interacted with the hinged overflow pan to place the hinged overflow pan in an open position.

In FIGS. 2A and 2B, the interaction of the movable portion 20 with an appliance seated within the overflow plan is schematically illustrated. In particular, it can be seen that an appliance 40 comprising a horizontally-extendable drawer 42 has been seated within overflow pan 10 such that the drawer 42 is extendible in the direction of the movable layer 16. The appliance 40 is raised slightly off the base 14 of the overflow pan 10 by legs 44. For an ordinary overflow pan comprising a fully fixed sidewall, the drawer 42 could not be opened. In order to permit the opening of the drawer 42, the sidewall of the overflow pan would have to be lowered, limiting the amount of potential fluid containment, or the legs 44 would have to be raised, reducing the stability of the appliance.

In the illustrated embodiment, it can be seen in FIG. 2B that the drawer 42 has been opened, and has interacted with the movable portion 20 of the sidewall to deflect the movable portion 20 to a lowered position, permitting the drawer 42 to pass through the space occupied by the movable layer 20 when in the first position.

For the purposes of clarity, the movable layer 20 is depicted as remaining in a lowered position spaced apart from the drawer 40, although it will be understood that in certain embodiments the movable layer may be retained against the underside of the drawer due to the biasing force exerted by spring 30. In such an embodiment, retraction of a drawer without catching on the movable portion 20 may be facilitated by providing a lip 18 along the upper edge of the movable portion 20. Thus, the drawer may be extended to afford access to a compartment within the drawer and may be retracted to fit within the pedestal. When the drawer is thus retracted from an extended position, any downwardly extending portions of the drawer may interact with the lip 18 to push the movable layer downward and permit passage of the drawer to a closed position. The movable layer 20 may then return to an upright position. The size and shape of the lip 18 may vary, and in certain embodiments, no lip 18 may be provided.

Figure 3A:
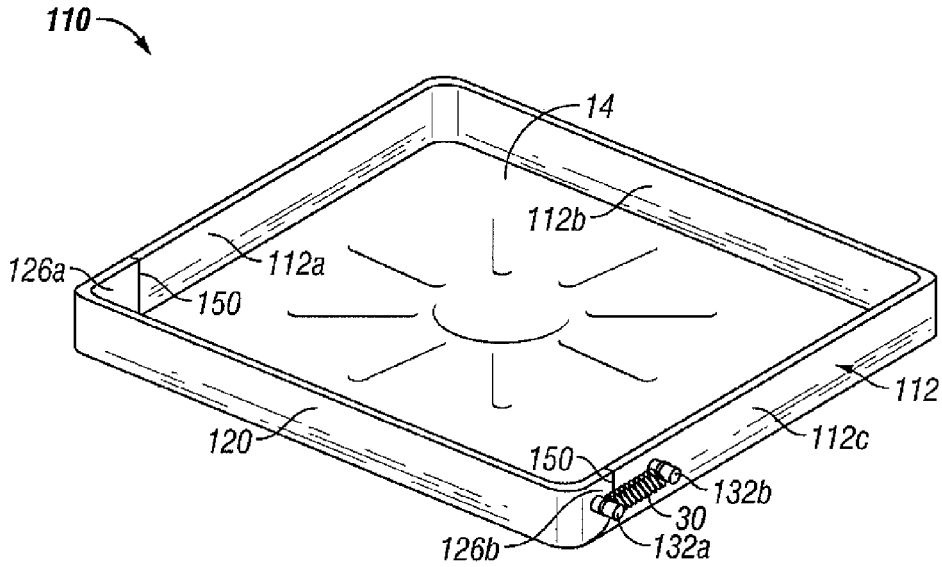
FIG. 3A is a perspective view of another embodiment of a hinged overflow pan, where the hinged overflow pan is shown in a closed position.
Figure 3B:
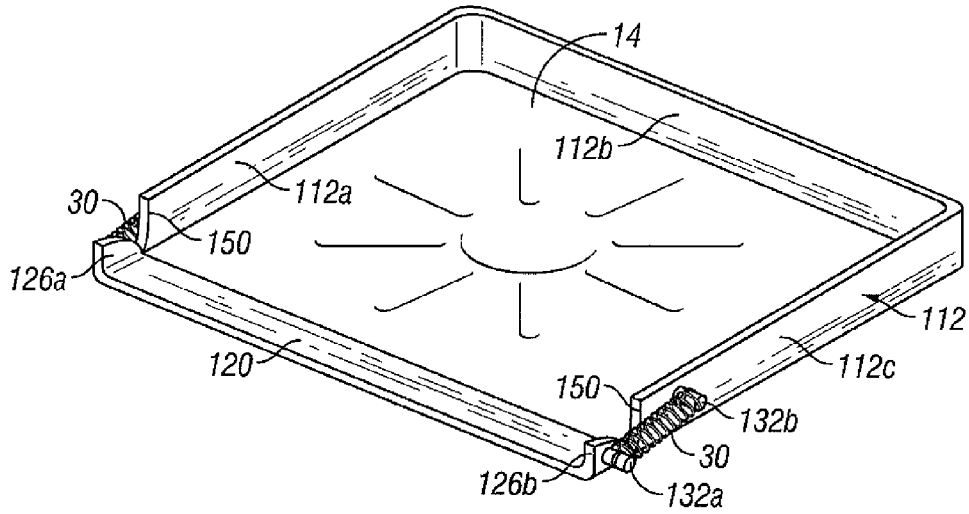
FIG. 3B is a perspective view of the hinged overflow pan of FIG. 3A, where the hinged overflow pan is shown in an open position.

FIGS. 3A and 3B illustrate an alternate embodiment of a hinged overflow pan 110 comprising a base 14 and an upwardly-extending sidewall structure 112 including a movable portion 120. In contrast to the hinged overflow pan 10 of FIGS. 1A-2B, the movable portion 120 of hinged overflow pan 110 extends not only in a lateral direction along the front edge of the base 14, but also comprises tabs 126*a* and 126*b* which extend at an angle to the laterally extending portion of the movable layer 120. In the illustrated embodiment, as the pan 110 has a rectangular shape, the tabs 126*a* and 126*b* extend in a substantially longitudinal direction. The movable layer 120 may be movable relative to the base by a living or mechanical hinge, or any other suitable connector, as discussed above.

The back sidewall 12*b* of hinged overflow pan 110 is similar to the back sidewall 12*b* of the overflow pan 10 of FIGS. 1A-2B, although it does not comprise a lip 18 along the top edge. As can best be seen in FIG. 3B, the lateral sidewalls 112*a* and 112*c* comprise scalloped abutment surfaces 150 shaped to receive the matching tabs 126*a* and 126*b* of the movable portion 120.

In the illustrated embodiment, the hinged overflow pan 110 comprises a spring 30 connected between a tab 132*a* extending from an exterior surface of the movable member 120, and a tab 132*b* extending from an exterior surface of the lateral sidewall 112*c*. Another spring 30 may be connected in a similar fashion between lateral surface 112*a* and tab 126*a*. It will be understood that in alternate embodiments, the spring may be connected between interior surfaces of the movable portion 120 and the remainder of the pan 110, as described with respect to the pan 10 of FIGS. 1A-1C.

As described above, the spring 30 may be configured to exert a biasing force on the movable portion 120 even when the movable portion is in an upright position. In such an embodiment the tabs 126*a* and 126*b* will be pressed against the abutment surfaces 150, facilitating a tight seal between the two components. In addition, one or both of the facing surfaces may be treated with a gasket material, as discussed above.

Figure 4A:
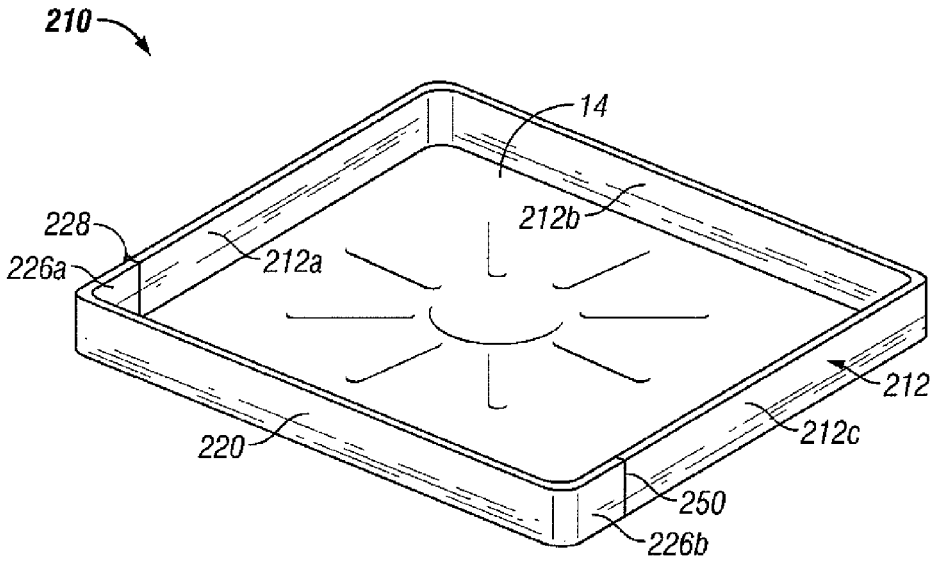
FIG. 4A is a perspective view of another embodiment of an overflow pan, where the overflow pan comprises a movable sidewall portion.
Figure 4B:
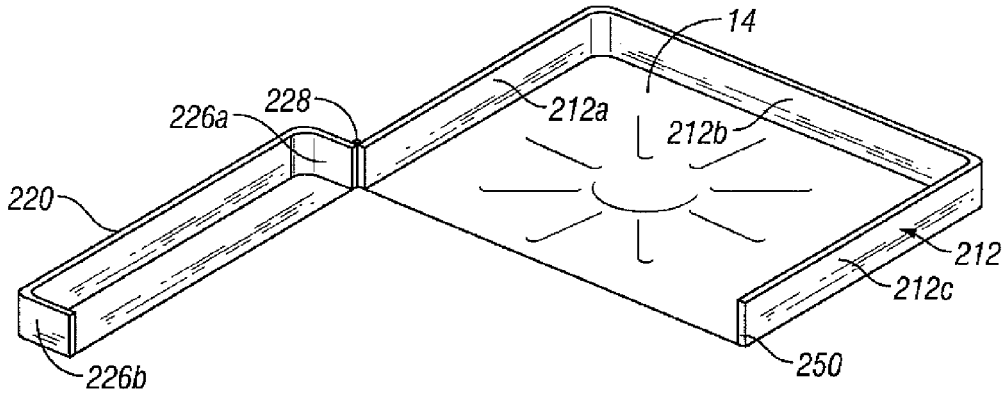
FIG. 4B is a perspective view of the overflow pan of FIG. 4A, where the movable sidewall portion is shown partially spaced apart from the remainder of the overflow pan.

In another embodiment, the movable portion of a hinged overflow pan may be hinged along the side of the movable portion, rather than along the base of the movable portion. Such an embodiment is shown with respect to FIGS. 4A and 4B. In this embodiment, the movable portion 220 again comprises a laterally extending side of the sidewall 212, as well as longitudinally extending tabs 226*a* and 226*b*. A hinge 222 connects the tab 226*a* to the lateral sidewall portion 212*a*. In the illustrated embodiment, hinge 222 comprises a mechanical hinge which includes a biasing spring configured to induce rotation of the movable portion 220 such that tab 226*b* contacts abutment surface 250. The facing surfaces of lateral sidewall 212*c* and tab 226*b* and the bottom surface of the movable portion 220 may be treated with a gasket material as discussed above.

In other embodiments, only a portion of the front side of the sidewall may be rotatable, similar in size to the movable member 20 of FIG. 1A-1C. In other embodiments, a biasing member connected to the non-hinged end of the movable portion 20 may be used to provide a biasing force in addition to or in place of a spring hinge. For example, an elastic strap or cord connected to tab 226*b* and the exterior surface of lateral sidewall 212*c* may be used to return the movable member 220 to a closed position.

Figure 5A:
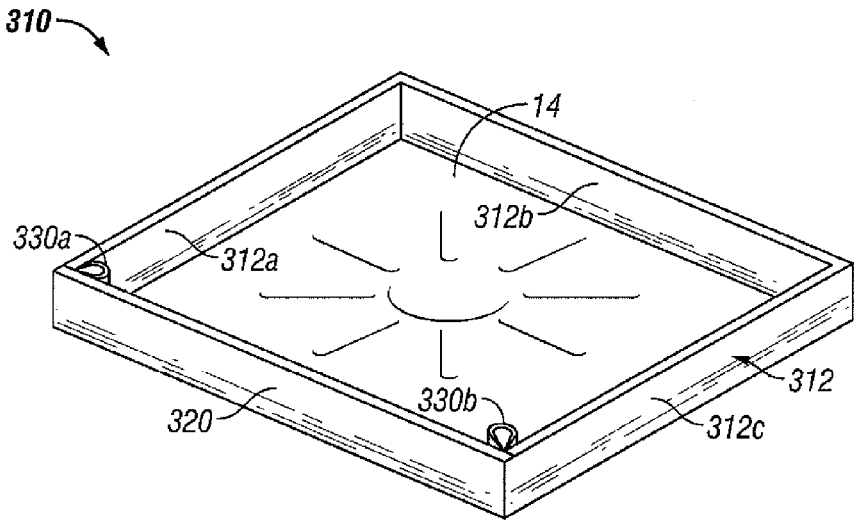
FIG. 5A is a perspective view of another embodiment of a hinged overflow pan, shown in a closed position.
Figure 5B:
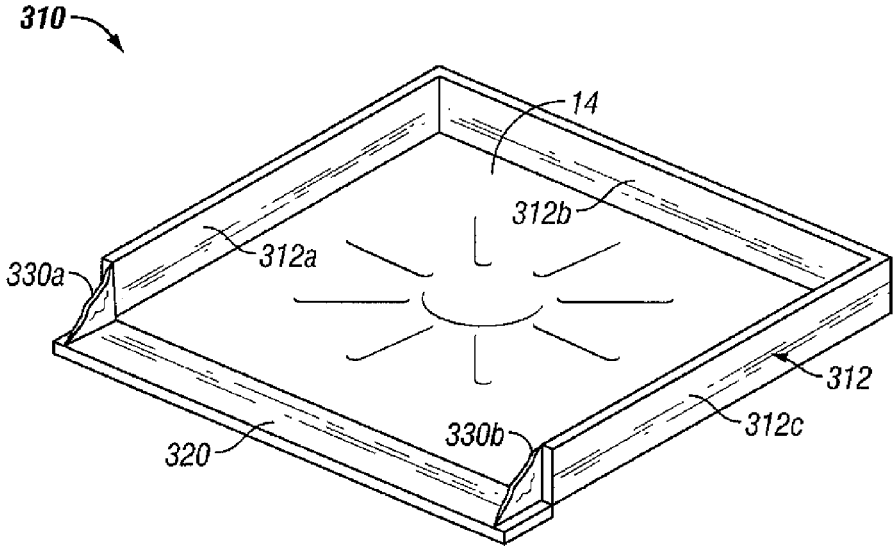
FIG. 5B is a perspective view of the hinged overflow pan of FIG. 5A, shown in an open position.

In another embodiment, an elastic liner may be used to return a movable portion of a hinged overflow pan to an upright position. FIGS. 5A and 5B depict a hinged overflow pan 310, which includes a sidewall 312 including movable front sidewall portion 320. Liner portion 330*a* is attached to the lateral sidewall portion 312*a* and movable portion 320 and liner portion 330*b* is attached to the lateral sidewall portion 312*c* and movable portion 320. In the illustrated embodiment the liner is attached to the interior surfaces of the sidewall portions, but may in alternate embodiments be attached to the outside surfaces.

In certain embodiments, the liner portions 330*a* and 330*b* may comprise portions of a continuous liner extending about a section of the sidewall. In certain embodiments, the liner may comprise a water-resistant material which assists in the formation of a fluid-tight seal, but in other embodiments, the liner may simply pull the movable portion 320 against the lateral sidewall portions 312*a* and 312*c* to form such a seal. A gasket may be provided between facing surfaces to further facilitate such a seal.

Figure 6A:
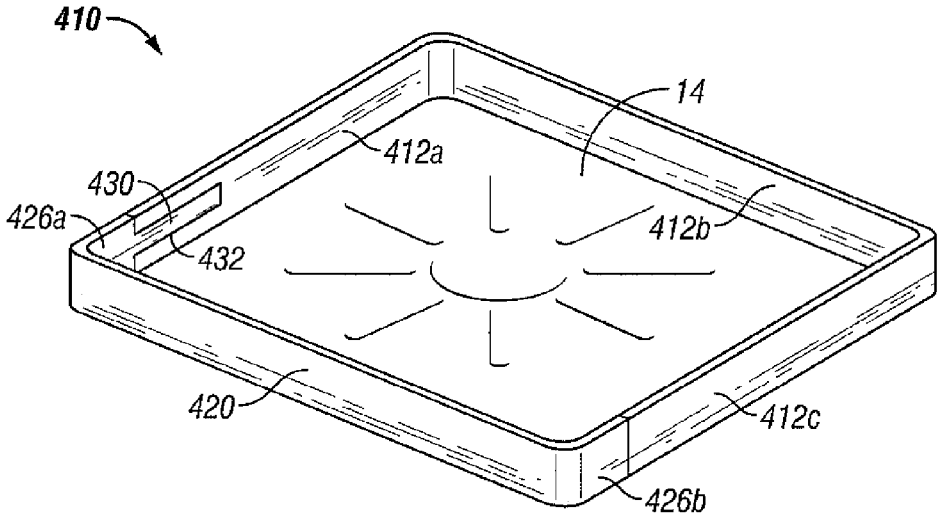
FIG. 6A is a perspective view of another embodiment of an overflow pan, where the overflow pan comprises a laterally displaceable sidewall portion.
Figure 6B:
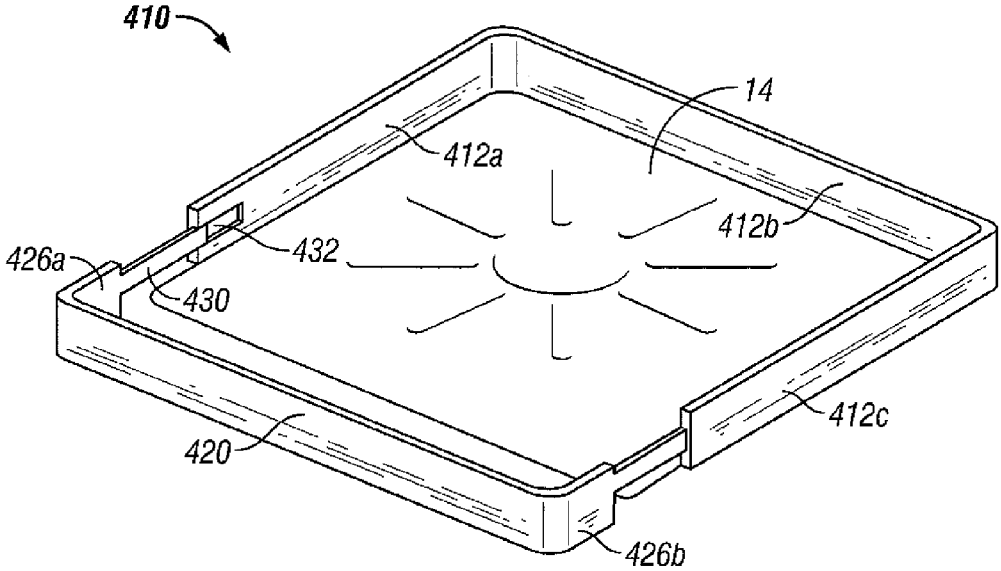
FIG. 6B is a perspective view of the overflow pan of FIG. 6A, where the laterally displaceable sidewall portion is shown spaced apart from the remainder of the overflow pan.

In another embodiment, a portion of the sidewall may be laterally displaceable with respect to the remainder of the overflow pan. FIGS. 6A and 613 depict an overflow pan 410, which includes fixed sidewall portions 412*a*, 412*b*, and 412*c*, as shown. At least a longitudinally extending portion sidewall portion 420 is slidably coupled to and laterally displaceable with respect to the remainder of the pan. Mechanisms such as dimples or biased ball bearings (not shown) may be employed to preferentially maintain the movable portion 420 in a particular position, such as a non-displaced position. In the illustrated embodiment, the movable portion 420 also includes laterally extending end portions 426*a* and 426*b*.

The movable portion 420 comprises laterally extending tabs 430 which are configured to slide on an integrated track within the fixed sidewall portions 412*a* and 412*c*. In certain embodiments, this may comprise an integrated molded plastic track slotted into the sidewall portions 412*a* and 412*c*. The movable portion 420 is configured to operate as a friction slider which forms a seal with the remainder of the overflow pan when the movable portion 420 is laterally displaced towards the remainder of pan 410.

When the drawer of a washing machine, or a similar horizontally extendable portion of a device retained within the overflow pan, is opened, the the drawer contacts the interior surface of the movable portion 420 and pushes the movable portion 420 away from the remainder of the pan. Upon retraction of the drawer, the movable portion 420 may be manually retracted to a closed position. In certain embodiments, the edges of the movable portion 420 which contact the remainder of the pan may be treated with a gasket material, and the fit between the edges may comprise a lap fold of material which overlaps the base 14 of the pan.

In certain embodiments, more complex components may be used. For example, the tabs 430 and corresponding grooves 432 in the fixed sidewall portions 412*a* and 412*b* may comprise telescoping members, such as a telescoping track or a telescoping tab member, which permit the movable portion 420 to be laterally displaced a greater distance from the. In other embodiments, a biasing member or mechanism may be used to return the movable portion 420 to a closed position.

In certain embodiments, installation of a hinged overflow pan such as the hinged overflow pans described above may proceed as follows. In many embodiments, such an overflow pan is used to direct fluid through an underlying drain. An aperture may be provided extending though the base of an overflow pan or a pre-perforated section may be provided which can be removed to form an aperture. In other embodiments, neither a perforation nor an aperture is provided in the pan. Nonetheless, an aperture may be formed through the base of the pan, such as by cutting through or puncturing the base. In the various embodiments, the exact location of the drain may vary, and site-specific forming of an aperture will permit more accurate placement of the overflow pan relative to the drain than might be possible through the use of a pre-formed or pre-perforated aperture. In other embodiments, all or a portion of the aperture may extend through a portion of the sidewall, rather than through the base.

In some embodiments, the overflow pan may be secured in place relative to the drain. In some embodiments, a grommet extending about the edge of the aperture may be used to secure the overflow pan relative to the drain.

Although described above with respect to rectangular overflow pans, it will be understood that a wide variety of shapes may be used, as well as any suitable number and shape of sidewall portions. In certain embodiments, the sidewall portions may be substantially straight, forming a polygonal shape, but in other embodiments, some or all of the sidewall portions may be curved, and the overflow pan may in certain embodiments comprise a circular or elliptical shape If a movable portion of the sidewall comprises a curvilinear shape, the movable portion may be hinged along only a portion of the base of the movable portion, rather than along the length of the base, as shown with respect to certain embodiments herein.

An appliance or other machinery may then be seated within the overflow pan. In embodiments in which a spring or other biasing structure is removable, it may be desirable to detach one side of the spring during this installation process. Doing so will permit the movable portion to be moved to a position which does not obstruct movement of the appliance through the space normally occupied by the movable portion. The appliance may then be seated within the overflow pan, and the spring or biasing structure reattached, if necessary. In embodiments in which the appliance is heavy or unwieldy, the pliability of certain materials may help to prevent damage to the overflow pan during this installation process, although pliability of the material is not required.

As can be seen in the above discussion, a variety of modifications may be made to each of the above embodiments and are contemplated within the scope of the invention. In addition, as noted above, the invention is not limited to hinged overflow pans utilized in conjunction with washing machines, although the embodiments discussed above have primarily been described with respect to that use. Rather, as noted above, various embodiments may be used to contain fluid leakage from a wide variety of appliances or other machinery.

Furthermore, the skilled artisan will recognize the interchangeability of various features from different embodiments. Although these techniques and systems have been disclosed in the context of certain embodiments and examples, it will be understood by those skilled in the art that these techniques and systems may be extended beyond the specifically disclosed embodiments to other embodiments and/or uses and obvious modifications and equivalents thereof. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the systems disclosed herein disclosed should not be limited by the particular disclosed embodiments described above.

What is claimed is:

1. An overflow pan, comprising:

a substantially flat base portion;

a sidewall structure extending transversely upward from the base to define a fluid-retaining basin, the sidewall structure comprising:

a first portion permanently affixed to the base portion;

a second portion connectively affixed to the base portion and movable between a first position in which the second portion is positioned relative to the first portion so as to maintain a fluid-tight seal between the second portion and the first portion, and a second position in which at least part of the second portion is spaced apart from the first portion, and wherein the second portion is biased to return to said first position; and a lip extending generally horizontally outward from at least a portion of an upper edge of the second portion in a direction in which the second portion is movable, wherein:

the second portion is configured to interact with an outwardly extending portion of an appliance disposed within the fluid-retaining basin to move the second portion towards the second position to permit extension of the longitudinally extending portion beyond the second portion of the sidewall; and the lip is configured to interact with the longitudinally extending portion of the appliance to move the second portion towards the second position to permit retraction of the outwardly extending portion of the applicance.

2. The overflow pan of claim 1, further comprising a biasing mechanism connected to the fixed portion and the movable portion of said sidewall structure, wherein said biasing mechanism is configured to return said movable portion to said first position.

3. The overflow pan of claim 2, wherein the biasing mechanism comprises a spring.

4. The overflow pan of claim 2, wherein the biasing mechanism comprises a flexible liner.

5. The overflow pan of claim 2, wherein the biasing mechanism is directly connected to the first and second portions of the sidewall structure.

6. The overflow pan of claim 1, wherein the second portion of the sidewall structure is connected to the base portion by a hinge extending along a laterally extending edge of the base portion.

7. The overflow pan of claim 6, wherein the second portion extends along a portion of the laterally extending edge of the base portion.

8. The overflow pan of claim 6, wherein both ends of the second portion comprise a tab extending at an angle to said laterally extending edge of the base portion, wherein said tab is configured to fit within a corresponding notch in the first portion of the sidewall structure.

9. The overflow pan of claim 1, further comprising a gasket located between the first and second portions of the sidewall structure to facilitate a fluid-tight seal therebetween when said second portion is in the first position.

10. The overflow pan of claim 1, wherein the second portion of the sidewall is longitudinally displaceable to the second position relative to the overflow pan.

11. The overflow pan of claim 1, wherein the second portion of the sidewall connected to the first portion and rotatable about the connected end to the second position.

12. The overflow pan of claim 1, wherein the sidewall structure is located at the periphery of the base portion.

13. The overflow pan of claim 1, wherein movement of the second portion to the second position permits the passage of an object through the space occupied by the second portion when the second portion is in the first position.

14. The overflow pan of claim 1, additionally comprising an aperture extending through the base portion of the pan.

15. A method of installing an overflow pan of claim 1, the method comprising:

positioning the overflow pan over a drain; and forming an aperture extending through the base portion of the overflow pan; and aligning the aperture with the drain.

16. The method of claim 15, further comprising installing a grommet within the aperture.

17. The method of claim 15, further comprising seating an appliance within the overflow pan.

18. An overflow pan configured to permit the passage of a longitudinally extending portion of an appliance seated within the pan, the overflow pan comprising:

a base, said base comprising a laterally extending side;

a sidewall extending upward from the base, said sidewall comprising:

a first portion fixed relative to the base;

a second portion connected to the laterally extending side of the base via a hinge at the base of the first portion; and a lip extending horizontally outward from an upper edge of the second portion; and a biasing structure configured to pull the second portion into an upright position wherein the second portion cooperates with the base and the first portion of the sidewall to define a fluid-retaining space;

wherein the second portion is configured to interact with a longitudinally extending portion of an appliance positioned within the pan to rotate the second portion of the sidewall about the hinge into a lowered position so as to permit the extension of the longitudinally extending portion of the appliance, and wherein the lip is configured to interact with the longitudinally extending portion of the appliance to rotate the second portion of the sidewall about the hinge into a lowered position so as to permit the retraction of the longitudinally extending portion of the appliance.

19. The overflow pan of claim 18, wherein the biasing structure is connected to an interior surface of the first portion of the sidewall and an interior surface of the second portion of the sidewall.

20. The overflow pan of claim 18, wherein the biasing structure is connected to an exterior surface of the first portion of the sidewall and an exterior surface of the second portion of the sidewall.

21. The overflow pan of claim 18, wherein the first portion of the sidewall extends along at least a portion of the laterally extending side of the base.

22. The overflow pan of claim 18, wherein the ends of the second portion of the sidewall comprise a tab portion extending at least partially in a longitudinal direction at an angle to the laterally extending side of the base.

23. The overflow pan of claim 18, wherein the sidewall extends about the periphery of the base.

24. A hinged containment pan, comprising:

a base, said base comprising a front side, two lateral sides, and a back side;

a sidewall extending around the sides of the base, wherein at least a portion of the sidewall adjacent the front side of the base is movable relative to the remainder of the sidewall to permit extension of a portion of an appliance seated within the pan to a location outside of the sidewall;

a lip extending generally horizontally outward from an upper edge of the movable portion of the sidewall in a direction in which the movable portion of the sidewall is movable, wherein the lip is configured to interact with the extendable portion of the appliance to displace the movable portion of the sidewall and allow retraction of the extendable portion of the appliance to a location within the sidewall; and a connector extending between the movable portion of the sidewall and a fixed component of the containment pan, wherein the connector is configured to exert a force on the movable portion to pull said movable portion towards a position in which the movable portion cooperates with the remainder of the sidewall to retain fluid within the containment pan.

25. The hinged containment pan of claim 24, wherein the movable portion of the sidewall is connected to the base via a living hinge.

26. The hinged containment pan of claim 24, wherein the connector comprises a spring.

27. The hinged containment pan of claim 24, wherein the connector comprises a flexible liner.

* * * * *